United States Patent [19]

Burkhart

[11] Patent Number: 5,022,658

[45] Date of Patent: Jun. 11, 1991

[54] ARROW PENETRATOR BRAKE ASSEMBLY

[76] Inventor: Jerald E. Burkhart, 1121 Cedar, Pratt, Kans. 67124

[21] Appl. No.: 452,305

[22] Filed: Dec. 19, 1989

[51] Int. Cl.[5] ..... F42B 6/04

[52] U.S. Cl. ..... 273/416

[58] Field of Search ..... 273/416, 419, 420, 421, 273/422

[56] References Cited

U.S. PATENT DOCUMENTS

| | | | |
|---|---|---|---|
| 2,876,760 | 3/1959 | Halverson | 273/416 X |
| 3,027,153 | 3/1962 | Zwickey | 273/419 X |
| 4,405,133 | 9/1983 | Cartwright, Jr. | 273/419 |
| 4,905,397 | 3/1990 | Juelg, Jr. | 273/419 X |

OTHER PUBLICATIONS

1986 Sanders Successories Catalog, p. 9, 7-1986, Arrow Penetration Limiter #5801.

Bowhunter Magazine, 11-1984, p. 113, Zwickey Scorpio.

*Primary Examiner*—Paul E. Shapiro

*Attorney, Agent, or Firm*—Phillip A. Rein

[57] ABSTRACT

An arrow penetrator brake assembly mounted on a conventional hunting arrow assembly and operable to provide a braking function when passing through game or into a brush area. The arrow penetrator brake assembly includes 1) a main support bushing membr; 2) a grabber spring member mounted on the main support bushing member and 3) a brake control member mounted about a main arrow shaft and engagable with the main support bushing member to achieve an adjustable braking function. The main support bushing member includes a spring retainer section for receiving and holding the grabber spring assembly. Impact force is transferred from the grabber spring assembly to the main support bushing member which engages the brake control member to achieve a controlled rearward axial movement of the arrow penetrator brake assembly on the main arrow shaft. The brake control member includes selected O-ring members of various diameters to increase or decrease the contact and resistance with the main arrow shaft so that the force needed to achieve rearward movement can be adjusted.

7 Claims, 2 Drawing Sheets

ARROW PENETRATOR BRAKE ASSEMBLY

PRIOR ART

A patent search on this invention revealed the following U.S. patents:

| Patent No. | Invention | Inventor |
|---|---|---|
| 2,989,310 | ARROW BRAKE AND INDICATOR DEVICES | Robert A. Lamond |
| 3,027,153 | SPRING STRUCTURES | Clifford J. Zwickey |
| 3,865,374 | ARROW LOCATING DEVICE | Fernando Troncoso, Jr. |
| 3,893,866 | ARROW HEAD WITH FLUENT MATERIAL RELEASE MEANS | Jimmy D. Hollingsworth |
| 4,111,424 | ARROW AND ARROW ATTACHMENT | Schreiber et al |
| 4,166,619 | SEQUENTIAL FUNCTION HUNTING ARROWS | Bergmann et al |
| 4,268,038 | ACCESSORY FOR AN ARROW | Allen J. Wierenga |
| 4,380,340 | BLEEDER ATTACHMENT FOR ARROWS | Miroslav A. Simo |
| 4,801,151 | ARROW STRING TRACKING APPARATUS | Sturm et al |

The Lamond patent discloses an arrow brake and indicator device which is similar in purpose and function for anchoring to the game and finding an arrow member in brush and the like. However, this device is held thereon by tape or a leaf spring and would catch on the feathers of the arrow member which is not desirable.

The Zwickey patent discloses a spring structure used on an arrow member and substantially teaches a grabber spring assembly which is one element in the overall combination of elements of the invention set forth herein.

The Troncoso, Jr. patent discloses a flexible rubber structure which aids in stabiling an arrow in flight and finding the arrow but is not otherwise pertinent to my invention.

The Hollingsworth patent discloses an attachment structure secured to a forward portion of an arrow and having O-ring members utilized therein. However, the function of this invention is to release a poison material within the game and the O-rings do not function similar to my invention.

The Schreiber et al patent discloses an arrow attachment structure having an aerodynamic device to decrease the range and movement of the arrow structure being an entirely different function relative to my invention.

The Bergmann et al patent discloses a hunting arrow structure having blade members which are moved outwardly on impact for a cutting function which will prevent the arrow structure from passing through the game.

The Wierenga patent discloses an accessory for an arrow which functions to cause further damage to the game and is not pertinent to your invention.

The Simo patent discloses a barblike structure which acts to increase damage to the small game by bleeding thereof.

The Sturm et al patent discloses an arrow tracking apparatus including a string member to be released on hitting the target which provides a string member, similar to a kite, for aid in locating the game and/or arrow.

PREFERRED EMBODIMENT OF THE INVENTION

In one preferred embodiment of this invention, an arrow penetrator brake assembly is operable to be used with a hunting arrow assembly when utilized to hunt game and the like. The hunting arrow assembly includes a main arrow shaft to which the arrow penetrator brake assembly of this invention is connected. The arrow penetrator brake assembly is operable on an arrowhead penetrating an object to provide a braking action and obstruction to prevent movement of the entire hunting arrow assembly through the subject object. The arrow penetrator brake assembly is also operable to restrict travel of the hunting arrow assembly through underbrush and the like so that it can be easily found and retrieved. The arrow penetrator brake assembly includes (1) a main support bushing member mounted about the main arrow shaft; (2) a grabber spring assembly connected to the main support bushing member and extended laterally therefrom; and (3) a brake control member mounted on the main support bushing member and engagable with the main arrow shaft to control the force needed to achieve a certain amount of relative movement of the arrow penetrator brake assembly on the main arrow shaft. The main support bushing member is provided with a main body with a central opening to receive the main arrow shaft therein; an outer spring retainer section to receive the grabber spring assembly thereon; and a tapered side wall to receive the brake control member therein. The grabber spring assembly is known in the prior art and provided with a plurality of main spring members, namely four thereof, each connected to one another and having a laterally extended gripper connector member. The gripper connector member is engagable with the game or the underbrush to act as a spring biased means for controlled axial movement of the main support bushing member on the main arrow shaft. The brake control member is a resilient O-ring member which is mounted about the main arrow shaft and engagable with the rear section and tapered side wall of the main support bushing assembly. The O-ring member provides for frictional contact and controlled amount of force needed for movement of the main support bushing member on the main arrow shaft. The O-ring member can be constructed of various diameters, both external and internal, in such a manner as to control the force needed to move the entire arrow penetrator brake assembly rearwardly on the main arrow shaft which is a desirable feature of this invention and not achieved by the prior art structures.

OBJECTS OF THE INVENTION

One object of this invention is to provide an arrow penetrator brake assembly which is mounted about a main arrow shaft on a hunting arrow assembly and having a laterally extended gripper spring assembly with a plurality of gripper connector members or arms which are engagable with game, an object, or the underbrush to aid in retrieval of the subject hunting arrow assembly.

Another object of this invention is to provide an arrow penetrator brake assembly which is mountable on a main arrow shaft adjacent to an arrowhead portion and operable to engage a game member and moved rearwardly under resistance from a brake control member engaging the main arrow shaft to assure that the hunting arrow assembly remains attached to the subject game member.

One other object of this invention is to provide an arrow penetrator brake assembly which is mountable on a main arrow shaft of a hunting arrow assembly to provide a braking function on striking an object and having a brake control member which can be selectively changed to increase and decrease resistance of movement of the subject arrow penetrator brake assembly on the main arrow shaft.

One further object of this invention is to provide an arrow penetrator brake assembly mounted on a main arrow shaft of a hunting arrow assembly to provide a braking means whether hitting a game member or underbrush so as to aid and assist in the location of the subject hunting arrow assembly so that it can be reused numerous times.

One other object of this invention is to provide an arrow penetrator brake assembly which can be attached to main arrow shafts of various diameters on a hunting arrow assembly and having adjustable means thereon which can be removed and replaced to provide for adjustable resistance of movement on the subject main arrow shaft depending on the desire of the operator utilizing same.

Still, one other object of this invention is to provide an arrow penetrator brake assembly which is readily mountable on existing hunting arrow assemblies of various lengths, materials, and diameters; economical to manufacture; readily reusable; providing a braking feature on encounter with game, objects, or underbrush; and substantially maintenance free.

Various other objects, advantages, and features of the invention will become apparent to those skilled in the art from the following discussion, taken in conjunction with the accompanying drawings, in which:

FIGURES OF THE INVENTION

Figure 9:
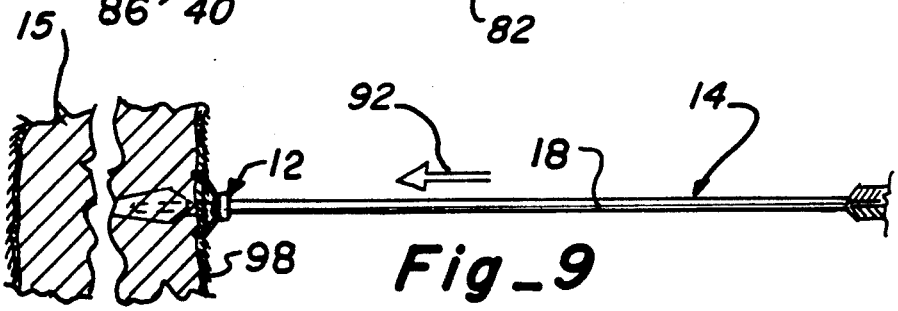
Figure 10:
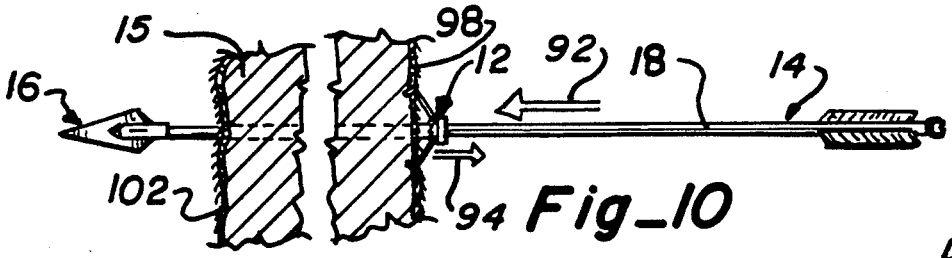
Figure 11:
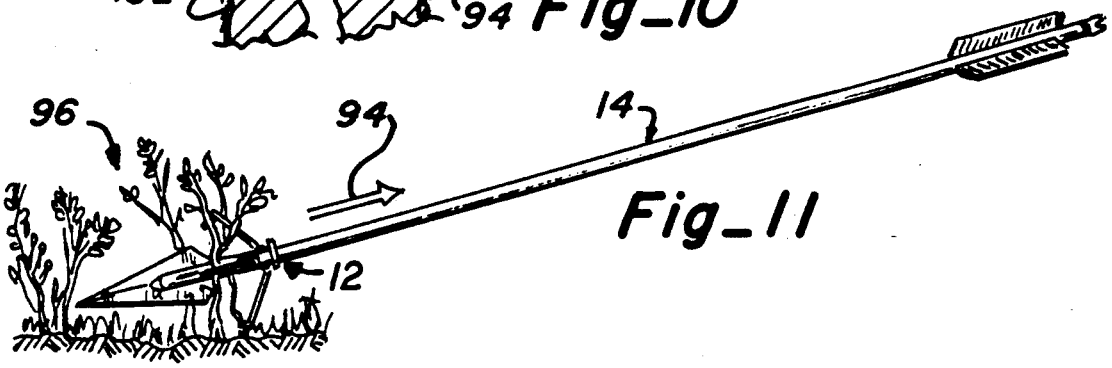

FIGS. 9 and 10 are schematic diagrams illustrating penetration of a hunting arrow assembly through small game and illustrating movement of the arrow penetrator brake assembly of this invention during such movement; and FIG. 11 is a side elevational view illustrating how the hunting arrow assembly having the arrow penetrator brake assembly of this invention mounted thereon acts as a braking force when engaging underbrush.

The following is a discussion and description of preferred specific embodiments of the arrow penetrator brake assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Figure 1:
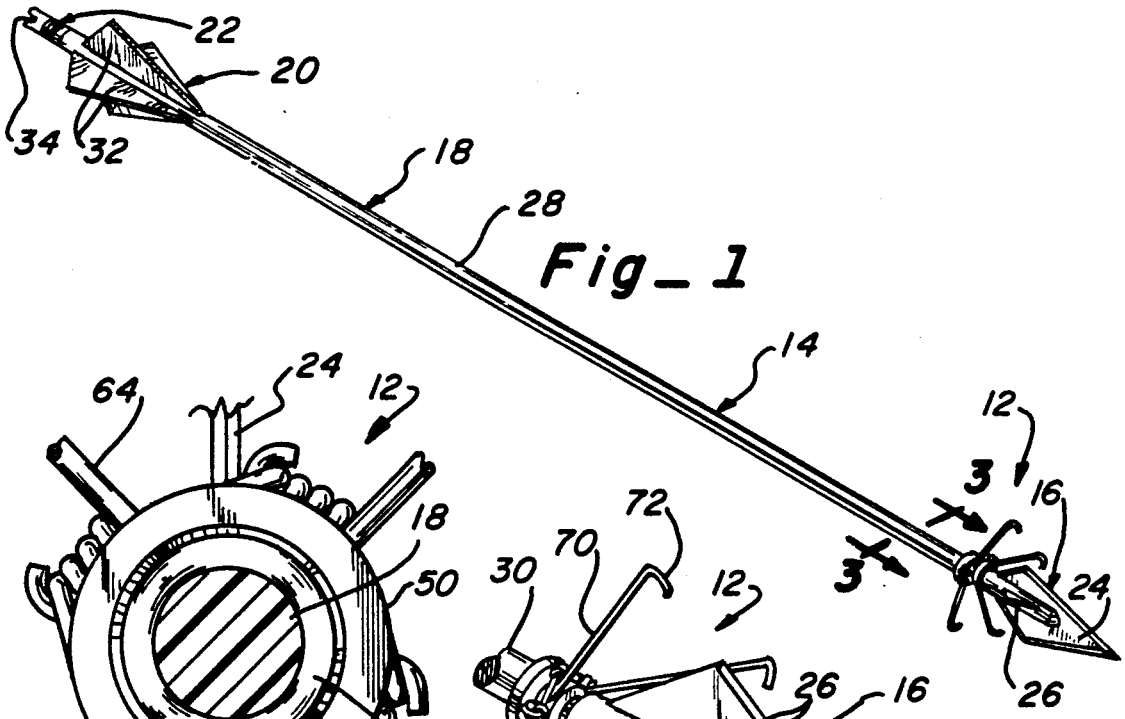
FIG. 1 is a perspective view of a hunting arrow assembly having an arrow penetrator brake assembly of this invention mounted thereon.
Figure 3:
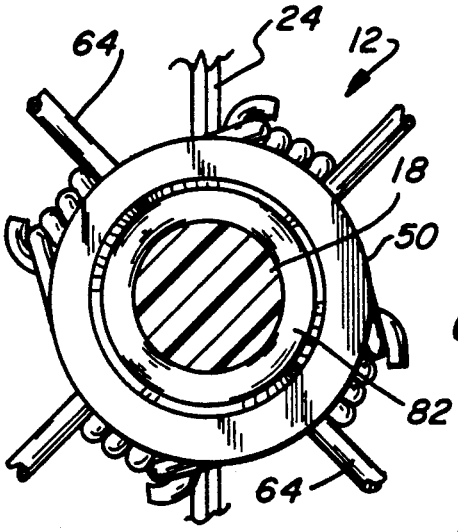
FIG. 3 is an enlarged fragmentary sectional view taken along line 3—3 in FIG. 1.
Figure 2:
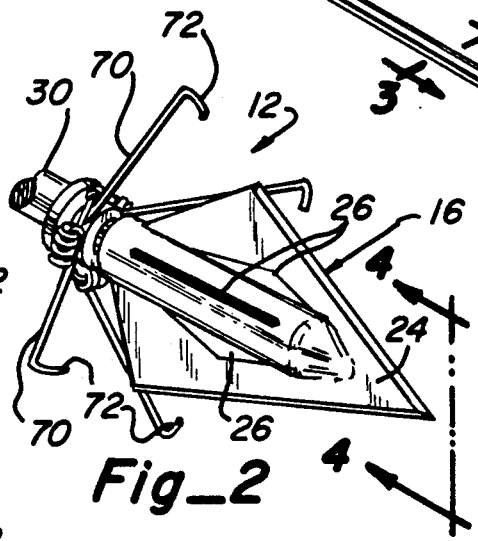
FIG. 2 is an enlarged perspective view of a penetrator assembly of the hunting arrow assembly having the arrow penetrator brake assembly of this invention mounted thereon.
Figure 4:
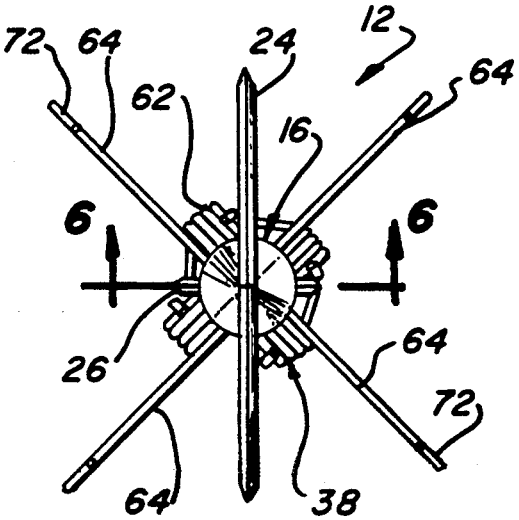
FIG. 4 is an enlarged front elevational view taken along line 4—4 in FIG. 2.
Figure 5:
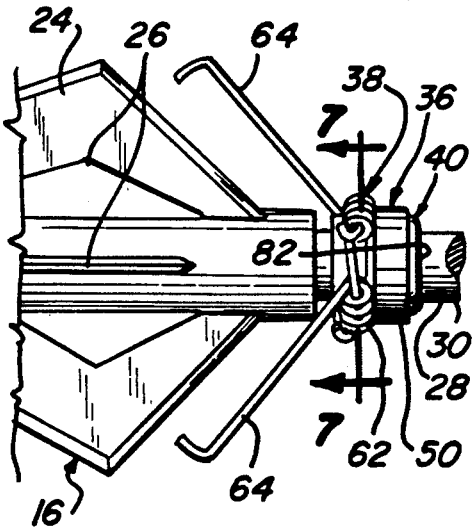
FIG. 5 is a fragmentary side elevational view of the penetrator assembly having the arrow penetrator brake assembly of this invention mounted thereon.

Referring to the drawings in details and, in particular to FIG. 1, an arrow penetrator brake assembly of this invention, indicated generally at 12, is shown as attached to a hunting arrow assembly 14 which can be utilized to hunt game 15 such as turkeys and the like.

The hunting arrow assembly 14 is of a generally conventional nature having a penetrator assembly 16 mounted on one end of a main arrow shaft 18 and a feather guide assembly 20 mounted at an opposite end thereof. The penetrator assembly 16 includes a main arrowhead 24 and having guide fins 26 associated therewith.

The main arrow shaft 18 can be of metal such as aluminum, plastic, or wood construction and includes a main cylinder body 28 having an outer surface 30 on which the arrow penetrator brake assembly 12 is slidably mounted in a manner to be described.

The feather guide assembly 20 is of a conventional nature having laterally extended feather members 32 placed adjacent and forwardly of a string connector section 22. The string connector section 22 is provided with a receiver slot 34 so as to be engageable by a bow string of a hunting bow member (not shown) for propelling the entire hunting arrow assembly 14 in a conventional manner toward the game 15 or other such object.

The arrow penetrator brake assembly 12 includes (1) a main support bushing member 36 mounted on the main arrow shaft 18; (2) a grabber spring assembly 38 mounted on the main support bushing member 36; and (3) a brake control member 40 which is mounted about the main arrow shaft 18 and engagable with a portion of the main support bushing member 36 to achieve an adjustable braking action as will be explained.

Figure 6:
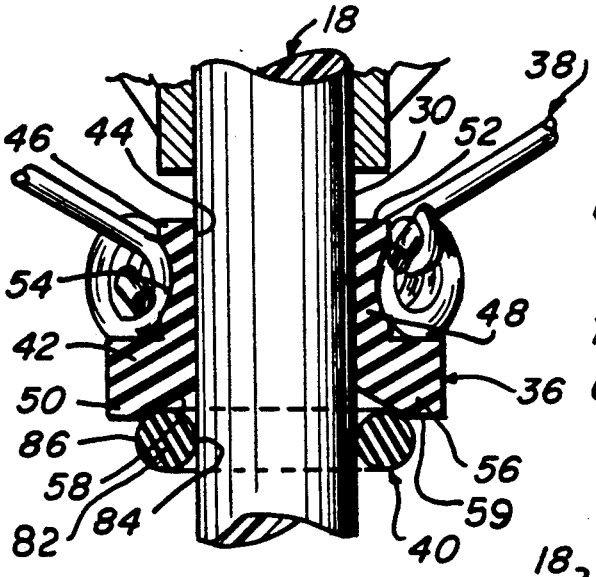
FIG. 6 is an enlarged fragmentary sectional view taken along line 6—6 in FIG. 4.

As noted in FIG. 6, the main support bushing member 36 includes (1) a main body 42 having a central opening 44; (2) a front section 46; (3) a spring retainer section 48; and (4) an integral rear section 50. The front section 46 is provided with a front wall 52.

The spring retainer section 48 is provided with an arcuate radial portion 54 to receive a curved portion of the grabber spring assembly 38 therein as will be explained.

The rear section 50 is provided with a flange portion 56 having a tapered side wall 58. The tapered side wall 58 is positioned at an angle of approximately 45 degrees to an adjacent end wall portion 59 and intersects the central opening 44.

The grabber spring assembly 38 includes a plurality, namely four (4), of cooperating main spring members 60, each having (1) a main coil body 62; (2) a gripper connector member 64 integral with a respective main coil body 62; and (3) a connector arm member 66 integral with the respective main coil body 62.

Each main coil body 62 is of a helical coil shape having adjacent circular coil elements 68.

An outer end portion of each of the gripper connector members 64 is integral with a laterally extended support arm section 70 having a gripper hook section 72 on an outer end thereof. The gripper hook section 72 is operable to engage the game 15, underbrush, or other objects to provide the braking feature of this invention as will be noted.

Figure 7:
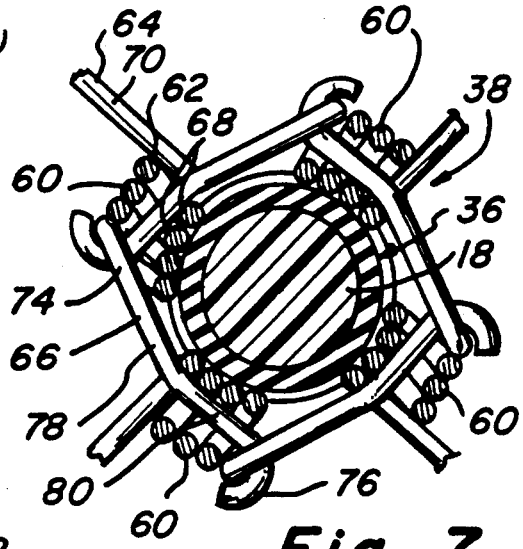
FIG. 7 is an enlarged fragmentary sectional view taken along line 7—7 in FIG. 5.

As noted in FIG. 7, each connector arm member 66 is provided with a connector section 74 integral with an opposite end of the respective circular elements 68 and having a connector hook section 76 connected thereto. Each connector hook section 76 is engagable with an adjoining one of the main spring members 60 as will be explained.

The connector section 74 is provided with a main body portion 78 integral with an angular portion 80 which cooperates to form a somewhat circular clamping shape about the main arrow shaft 18 as best noted in FIG. 7.

As noted in FIG. 6, the brake control member 40 comprises a resilient O-ring member 82 having an internal diameter 84 to contact the outer surface 30 of the main arrow shaft 18 and having an outer surface 86 operable to contact the tapered side wall 58 of the rear section 50 of the main support bushing member 36 for controlled braking movement as will be described.

Figure 8:
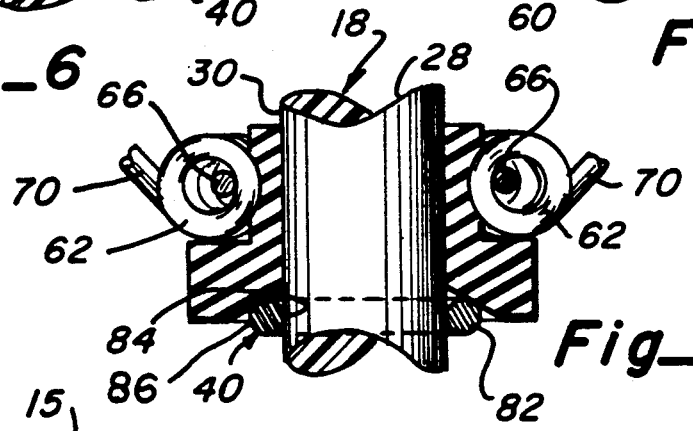
FIG. 8 is a view similar to FIG. 6 illustrating another embodiment of a brake control member of the arrow penetrator brake assembly of this invention.

The O-ring member 82, as noted in FIG. 8, can be constructed of a smaller internal diameter 84 and a smaller diameter outer surface 86 so as to differently engage the tapered side wall 58. The purpose of the variation in sized of the O-ring member 82 is to provide a different resistance to movement of the entire arrow penetrator brake assembly 12 on the main arrow shaft 18 depending on the type of material of the main arrow shaft 18 (whether metal, wood, or the like) and to increase and decrease resistance to rearward movement of the arrow penetrator brake assembly 12 when the hunting arrow assembly 14 is moving in the direction of an arrow 92 as will be explained.

It is obvious that a smaller internal diameter 84 of the O-ring member 82 relative to the outer surface 30 of the main arrow shaft 18 plus the outer diameter of the outer surface 86 will determine the force required for movement of the arrow penetrator brake assembly 12 on the arrow shaft 18 rearwardly as noted by an arrow 94 in FIG. 11 as will be explained.

USE AND OPERATION OF THE INVENTION

In the use and operation of the arrow penetrator brake assembly 12 of this invention, it is noted that that hunting arrow assembly 14 resembles a conventional structure and does not perform an integral part of this invention. Additionally, the specific structure of the grabber spring assembly 38 herein is substantially described in U.S. Pat. No. 3,027,153, inventor C. J. Zwickey, issued Mar. 27, 1962. This spring structure was originally designed and patented for a brake structure on an arrow shaft and the applicant's invention herein sets forth a new, novel, and unique improvement thereover.

It is obvious that the arrow penetrator brake assembly 12 of this invention can be mounted on the main arrow shaft 18 by first removing the penetrator assembly 16 from the main arrow shaft 18. Next, the operator slides the arrow penetrator brake assembly 12 on the main arrow shaft 18 conjointly with the proper selection of the brake control member 40 or O-ring member 82 to be used therewith. Thereupon, the penetrator assembly 16 can be mounted on and properly secured to an outer end of the main arrow shaft 18 to assume the assemblied condition as noted in FIG. 1.

The arrow penetrator brake assembly 12 is thereupon placed adjacent to the penetrator assembly 16 and having the proper size of the O-ring member 82, whether the large size of FIG. 6, the smaller size of FIG. 8, or any combination of internal diameter 84 and external diameter of the outer surface 86. The selection is to achieve a desired frictional engagement between a surface of the internal diameter 84 of the O-ring member 82 against the outer surface 30 of the main arrow shaft 18 and, additionally, between the outer surface 86 of the O-ring member 82 and the inclined tapered side wall 58 of the rear section 50 of the main support bushing member 36 as noted in FIG. 6.

On use of the arrow penetrator brake assembly 12 mounted on the hunting arrow assembly 14 for hunting game 15 as noted in FIG. 9, the hunting arrow assembly 14 is projected from a hunting bow member (not shown) and propelled in a direction indicated by the arrow 92 in FIGS. 9 and 10. On initially hitting an outer surface 98 of the game 15, it is seen that the hunting arrow assembly 14 continues to move forward whereupon the grabber spring assembly 38 grabs onto the outer surface 98 of the game 15. The arrow penetrator brake assembly 12 thereupon slides rearwardly on the forwardly moving main arrow shaft 18 of the hunting arrow assembly 14.

As noted in FIG. 10, the penetrator assembly 16 may thereupon exit through an outer surface 102 of the game 15. Then, due to the action of the arrow penetrator brake assembly 12 of this invention, the hunting arrow assembly 14 ceases its forward movement indicated by arrow 92 in conjunction with cessation of movement of the arrow penetrator brake assembly 12 in a direction as shown by arrow 94. This causes the hunting arrow assembly 14 to not pass completely through the game 15 which aids in hindering the elusive continued movement of the game 15 by contact of the hunting arrow assembly 14 with the adjacent, surrounding underbrush 96. The game 15 then can be more easily located by the operator of the hunting arrow assembly 14 plus aiding in the retrieving of the hunting arrow assembly 14 which would be found in the subject game 15 as it was stopped from passing through the game 15.

Depending on the type of game 15 being utilized (whether turkeys, deer, or the like) the effective rearward movement of the arrow penetrator brake assembly 12 can be adjusted by changing the size of the O-ring member 82 of the brake control member 40 to achieve a different result in movement which cannot be regulated and achieved by the prior art structures.

Another important advantageous purpose and function of the arrow penetrator brake assembly 12 of this invention is noted in FIG. 11 whereupon the hunting arrow assembly 14 has been first propelled by the user thereof from the hunting bow (not shown). In this instance, hunting arrow assembly 14 has failed to hit its mark of the game 15 and, instead, proceeds into the brush area 96. When this happens, it is noted that the arrow penetrator brake assembly 12 will contact the brush area 96 and move rearwardly on the main arrow shaft 18 as noted by arrow 94 in FIG. 11. This then impedes the forward motion of the hunting arrow assembly 14 through subject brush and tree members and, eventually, stops forward movement. This results in the easy observation and recovery of the hunting arrow assembly 14 by the operator thereof which is another important feature and function of the arrow penetrator brake assembly 12 of this invention.

It is noted that use of the arrow penetrator brake assembly 12 and, more specifically, the main support bushing member 36 with the grabber spring assembly 38 thereon and controlled movement by the brake control member 40 achieves a new, novel, and unusual result over the prior art structures cited herein.

The arrow penetrator brake assembly provides a new and novel structure which can be readily mounted on exiting main arrow shafts of hunting arrow assemblies and provides for the controlled axial movement thereon due to the unique main support bushing member of this invention. Also, the interchangability of the brake control member operates to achieve adjustable retarded movement of the arrow penetrator brake assembly on the main arrow shaft which is not achieved by the prior art structures.

It is noted that the arrow penetrator brake assembly of this invention is readily mounted on existing main arrow shafts; easy to install; sturdy in construction; reliable in operation; and substantially maintenance free.

While the invention has been described in conjunction with preferred specific embodiments thereof, it will be understood this description is intended to illustrate and not to limit the scope of the invention, which is defined by the following claims:

I claim:

1. An arrow penetrator brake assembly mountable on a main arrow shaft of a hunting arrow assembly to impede forward movement thereof on contacting an object, comprising:

(a) a main support bushing member mounted about and moveable on the main arrow shaft;

(b) a gripper spring assembly mounted on said main support bushing member and extended laterally thereof;

(c) a brake control member mounted about the main arrow shaft and engagable with a portion of said main support bushing member to provide for a unique controlled braking action of said arrow penetrator brake assembly on the main arrow shaft; and (d) said main support bushing member having a rear section with a tapered side wall to receive said brake control member therein to provide a force between said tapered side wall and the main arrow shaft to provide controlled, braked rearward movement thereon;

whereby said gripper spring assembly is engagable with the object and transfers force to said main support bushing member to impede (1) rearward movement on the main arrow shaft and (2) forward movement of the hunting arrow assembly.

2. An arrow penetrator brake assembly as described in claim 1, wherein:

(a) said brake control member provided of various sizes and can be readily interchanged on the main arrow shaft to achieve variable impedement to rearward movement of said main support bushing member on the main arrow shaft.

3. An arrow penetrator brake assembly as described in claim 1, wherein:

(a) said brake control member being an O-ring member in contact and mounted about the main arrow shaft and contacting said tapered side wall to provide for resistance of rearward movement of said arrow penetrator brake assembly on the main arrow shaft.

4. An arrow penetrator brake assembly mountable on a main arrow shaft of a hunting bow assembly to initially impede and then stop forward motion of a projected hunting arrow assembly on contacting an object, comprising:

(a) a main support bushing member mounted about and moveable axially on said main arrow shaft;

(b) a gripper spring assembly mounted on said main support bushing member and extended laterally thereof and operable to contact the object to impede forward motion after penetration of said hunting arrow assembly into the object;

(c) a brake control member mounted on said main support bushing member and engagable with said main arrow shaft to provide a frictional contact therewithin and a controlled impedance to rearward motion on said main arrow shaft when striking the object;

(d) said main support bushing member having a main body with a central opening to receive said main arrow shaft therethrough, a spring retainer section to receive said gripper spring assembly therein to retain same thereon, and a rear section having a tapered side wall integral with said central opening; and (e) said tapered side wall at an angular relationship to said central opening and said main arrow shaft and operable to receive said brake control member therein to provide an impedance against forward movement of said main arrow shaft relative to said main support bushing member which contacts the object through said gripper spring assembly.

5. An arrow penetrator brake assembly as described in claim 4, wherein:

(a) said brake control member includes a plurality of O-ring members with selective variable internal diameters and outer diameters to vary a resistance of movement of said main support bushing member on said main arrow shaft.

6. An arrow penetrator brake assembly mountable on a main arrow shaft of a hunting arrow assembly to impede forward movement thereof on contacting an object, comprising:

(a) a main support bushing member mounted about and moveable on the main arrow shaft;

(b) a gripper spring assembly mounted on said main support bushing member and extended laterally thereof;

(c) said main support bushing member includes an opening to receive the main arrow shaft therethrough and a spring retainer section having a portion of said grabber spring assembly mounted thereupon to transfer force from said gripper spring assembly to said main support bushing member on hitting the object for axial movement on the main arrow shaft while preventing damage thereto;

(d) a brake control member mounted about the main arrow shaft and engagable with a side wall of said main support bushing member to provide for a unique controlled braking action of said arrow penetrator assembly on the main arrow shaft; and (e) said side wall being tapered to receive said brake control member therein between said side wall and the main arrow shaft to provide controlled, braked rearward movement thereon;

whereby said gripper spring assembly is engagable with the object and transfers force to said main support bushing member to impede (1) rearward movement on the main arrow shaft and (2) forward movement of the hunting arrow assembly.

7. An arrow penetrator brake assembly mountable on a main arrow shaft of a hunting bow assembly to initially impede and then stop forward motion of a projected hunting arrow assembly on contacting an object, comprising:

(a) a main support bushing member mounted about and moveable axially on said main arrow shaft;

(b) a gripper spring assembly mounted on said main support bushing member and extended laterally thereof;

(c) a brake control member mounted on and axially moveable with said main support bushing member and concurrently engagable with said main arrow shaft to provide a frictional contact therewithin and a controlled impedance to rearward motion on said main arrow shaft when striking the object; and (d) said brake control member includes a plurality of O-ring members with variable inner and outer diameters to selectively regulate resistance of movement on said main arrow shaft.

* * * * *